US011261868B2

(12) United States Patent
Schnurr et al.

(10) Patent No.: US 11,261,868 B2
(45) Date of Patent: Mar. 1, 2022

(54) VANE GAS PUMP WITH SLIDING ELEMENT TRMPORAILY COMPLETELY COVERING THE ELONGATED FLUID OUTLET OPENING

(71) Applicant: PIERBURG PUMP TECHNOLOGY GMBH, Neuss (DE)

(72) Inventors: Steffen Schnurr, Essen (DE); Sebastian Cramer, Pulheim (DE); Nabil Salim Al-Hasan, Korschenbroich (DE); Stanislaus Russ, Moenchengladbach (DE); Tobias Gruene, Arnsberg (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 292 days.

(21) Appl. No.: 16/481,489

(22) PCT Filed: Feb. 1, 2017

(86) PCT No.: PCT/EP2017/052167
§ 371 (c)(1),
(2) Date: Jul. 29, 2019

(87) PCT Pub. No.: WO2018/141381
PCT Pub. Date: Aug. 9, 2018

(65) Prior Publication Data

US 2019/0345943 A1 Nov. 14, 2019

(51) Int. Cl.
*F04C 29/12* (2006.01)
*F04C 18/344* (2006.01)

(52) U.S. Cl.
CPC ..... *F04C 29/12* (2013.01); *F04C 18/3446* (2013.01); *F04C 2240/30* (2013.01)

(58) Field of Classification Search
CPC ..... F04C 18/344; F04C 18/3446; F04C 2240/30; F04C 29/12
See application file for complete search history.

(56) References Cited

U.S. PATENT DOCUMENTS 3,320,899 A 5/1967 von Thuengen et al.
4,408,968 A * 10/1983 Inagaki ..... F04C 18/3441 418/15

(Continued)

FOREIGN PATENT DOCUMENTS

CN 104471251 A 3/2015
CN 104995409 A 10/2015

(Continued)

OTHER PUBLICATIONS

Machine Translation of Japanese Patent Publication JP S62-247194 A, published: Oct. 28, 1987; Inventor: Atsumi. (Year: 1987).*

(Continued)

*Primary Examiner* — Mary Davis
(74) *Attorney, Agent, or Firm* — Norman B. Thot

(57) ABSTRACT

A vane type gas pump for a compressible fluid. The vane-type gas pump includes a pump housing which forms a pump chamber in which a pump rotor with at least one slidable sliding element is rotatably mounted. At least one fluid inlet opening and at least one elongated fluid outlet opening are dedicated to the pump chamber. The at least one slidable sliding element has a tangential width. The at least one elongated fluid outlet opening has a tangential width. The tangential width of the at least one slidable sliding element at least corresponds to the tangential width of the at least one elongated fluid outlet opening so that the at least one slidable sliding element temporarily completely covers the at least one elongated fluid outlet opening.

7 Claims, 2 Drawing Sheets

(56) References Cited

U.S. PATENT DOCUMENTS

| | | | | |
|---|---|---|---|---|
| 10,995,757 | B2 * | 5/2021 | Gruene | F04C 29/12 |
| 11,053,940 | B2 * | 7/2021 | Ott | F04C 18/344 |
| 2015/0147216 | A1 | 5/2015 | Shimaguchi et al. | |
| 2015/0292503 | A1 | 10/2015 | Kopp | |
| 2016/0010642 | A1 | 1/2016 | Akatsuka et al. | |

FOREIGN PATENT DOCUMENTS

| | | | |
|---|---|---|---|
| CN | 105074216 | A | 11/2015 |
| EP | 2 568 180 | A1 | 3/2013 |
| JP | S62-247194 | A | 10/1987 |
| JP | S62-265483 | A | 11/1987 |
| WO | WO 2016/104652 | A1 | 6/2016 |

OTHER PUBLICATIONS

Machine Translation of World Intellectual Property Publication WO 2016/104652 A1, published: Jun. 30, 2016; Inventor: Tanaka. (Year: 2016).*

* cited by examiner

VANE GAS PUMP WITH SLIDING ELEMENT TRMPORAILY COMPLETELY COVERING THE ELONGATED FLUID OUTLET OPENING

CROSS REFERENCE TO PRIOR APPLICATIONS

This application is a U.S. National Phase application under 35 U.S.C. § 371 of International Application No. PCT/EP2017/052167, filed on Feb. 1, 2017. The International Application was published in German on Aug. 9, 2018 as WO 2018/141381 A1 under PCT Article 21(2).

FIELD

The present invention relates to a vane-type gas pump.

BACKGROUND

Vane-type gas pumps have previously been described and are used in vehicles as so-called vacuum pumps, usually in combination with a brake power unit. The vane-type gas pump provides the vacuum pressure required to operate the brake power unit, wherein the vacuum pressure is normally 100 mbar absolute or less.

Previously described vane-type gas pumps are usually dry-running or oil-lubricated vane-type gas pumps, wherein, in the case of dry-running gas pumps, no lubricant is passed into the pump chamber. In the case of oil-lubricated vane-type pumps, the air escaping from the pump chamber is mixed with the lubricant so that the air-lubricant mixture must be separated elaborately into its components before disposure. The contamination of the air escaping from the pump chamber can be prevented by omitting the lubricant. However, omitting the lubricant results in an increased abrasion of the components moving relative to each other, in particular the sliding elements. The abrasion is usually reduced to a minimum by specifically selecting appropriate material pairs for the abutting components and for the components moving relative to each other.

A dry-running vane-type gas pump is described in EP 2 568 180 A1 which comprises a pump housing forming a pump chamber. A pump rotor having five radially slidable sliding elements is arranged in the pump chamber. The pump rotor is connected non-rotatably to an electric motor and is driven by the electric motor. If the pump rotor rotates, the sliding elements are slid due to the centrifugal force acting on the sliding elements so that they respectively abut with their head on a circumferential wall of the pump chamber. Two adjacent sliding elements together define with the pump rotor and the pump housing, respectively, one circumferential pump compartment. A fluid inlet opening dedicated to the pump chamber and two fluid outlet openings dedicated to the pump chamber are arranged in the pump housing, wherein the fluid outlet openings comprise a circular opening cross-section.

A disadvantage of the embodiment described in EP 2 568 180 A1 is that the opening cross-sections of the circular fluid outlet openings must have a specific size in order to provide a low flow resistance. A short-term short circuit occurs between two adjacent pump compartments, however, when the corresponding sliding element passes the fluid outlet opening. Such a short circuit results in an increased leakage on the individual sliding elements, thereby reducing the pneumatic efficiency of the vane-type gas pump. If the fluid outlet opening is downsized, the flow resistance increases, whereby an overpressure prevails in the pump compartments in the outlet area at high rotational speed. The sliding elements are thus additionally mechanically loaded, and the abrasion of the sliding elements is increased.

SUMMARY

An aspect of the present invention is to provide a vane-type gas pump with a low abrasion of the sliding elements and a good pneumatic efficiency.

In an embodiment, the present invention provides a vane type gas pump for a compressible fluid. The vane-type gas pump includes a pump housing which is configured to form a pump chamber in which a pump rotor comprising at least one slidable sliding element is rotatably mounted. At least one fluid inlet opening and at least one elongated fluid outlet opening are dedicated to the pump chamber. The at least one slidable sliding element comprises a tangential width. The at least one elongated fluid outlet opening comprises a tangential width. The tangential width of the at least one slidable sliding element at least corresponds to the tangential width of the at least one elongated fluid outlet opening so that the at least one slidable sliding element temporarily completely covers the at least one elongated fluid outlet opening.

BRIEF DESCRIPTION OF THE DRAWINGS

The present invention is described in greater detail below on the basis of embodiments and of the drawings in which.

DETAILED DESCRIPTION

Figure 1:
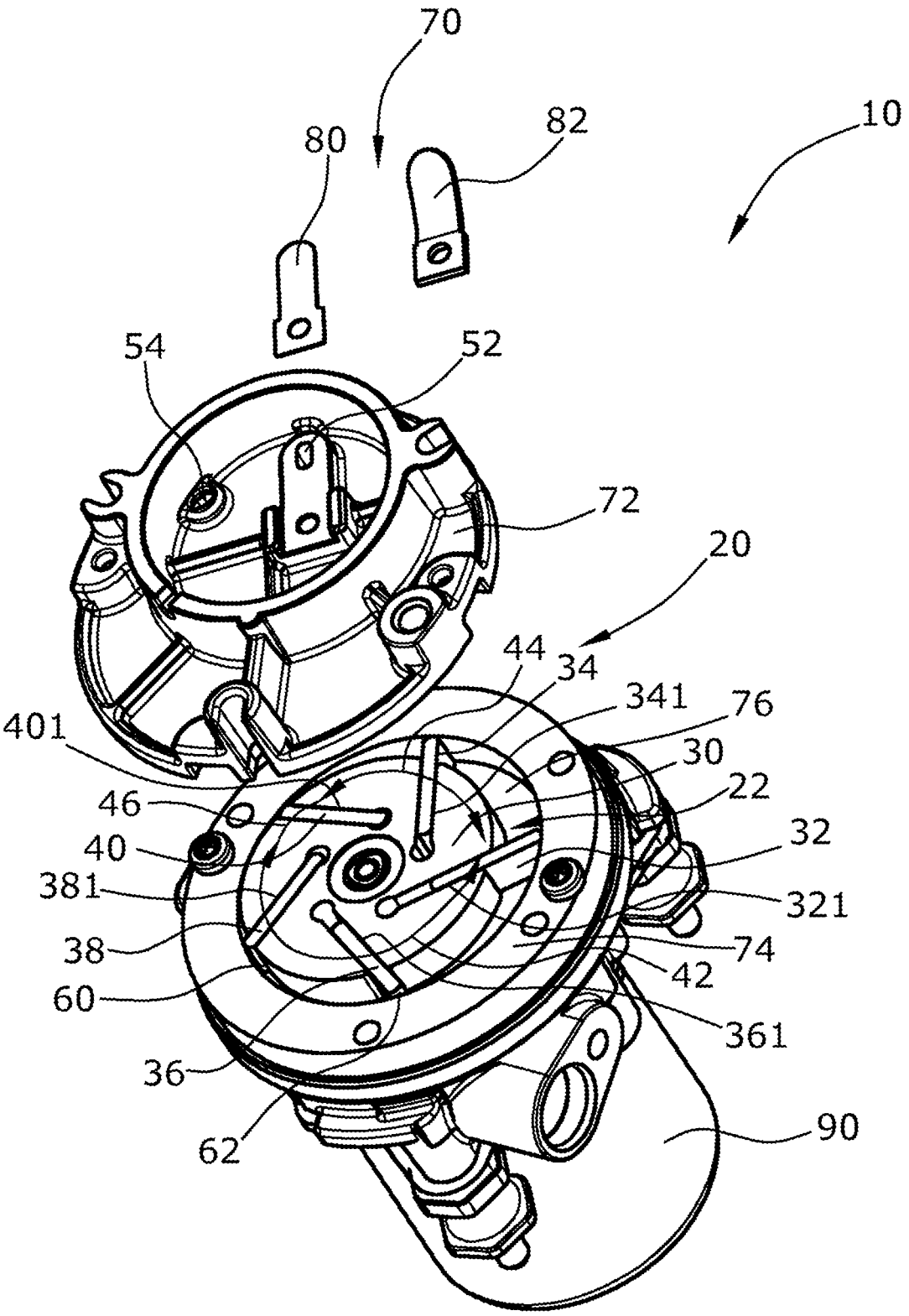
FIG. 1 shows an exploded view of the vane-type gas pump.

The vane-type gas pump according to the present invention comprises a pump housing defining a pump chamber. A pump rotor is arranged in the pump chamber that is either driven electrically by a dedicated electric motor or mechanically by a combustion engine. The pump rotor is eccentrically arranged in the pump chamber and provides together with the circumferential wall of the pump chamber a sealing gap defining the sealing sector, whereby a crescent-shaped working chamber is defined outside the sealing sector.

At least one slidable sliding element is mounted in the pump rotor. For mounting the at least one sliding element, the pump rotor comprises a sliding slot in which the at least one sliding element is respectively slidably mounted and arranged. For a rotating pump rotor, the at least one sliding element is slid due to the centrifugal force acting on the sliding element so that the sliding element always abuts with its head on the circumferential wall of the pump chamber. The at least one sliding element can also be spring-loaded so that the head of the at least one sliding element abuts on the circumferential wall of the pump chamber due to the centrifugal force, even at a low rotational speed.

The pump chamber is divided in terms of function into an inlet sector, an outlet sector, and a sealing sector. At least one fluid inlet opening is arranged in the inlet sector which, when the gas pump is installed, is in fluid communication, for example, with a low-pressure chamber of a brake power unit. At least one fluid outlet opening is arranged in the outlet sector, wherein the pump chamber is connected to the atmospheric environment via the fluid outlet opening. The sealing sector is arranged between the fluid outlet opening and the fluid inlet opening, as viewed in a rotational direction, the sealing sector being provided by the pump rotor being positioned so close to the pump housing that a gas flow between the fluid inlet opening and the fluid outlet opening is not possible.

The at least one fluid outlet opening is designed as a longitudinal hole. The tangential width of the sliding element at least corresponds to the tangential width of the elongated fluid outlet opening, wherein the elongated fluid outlet opening is aligned so that the complete fluid outlet opening is covered and closed by the sliding element for a short period of time. The tangential width of the sliding element relates to the transverse direction relative to the linear movement path of the sliding element. The tangential width of the elongated fluid outlet opening is aligned perpendicular to the sliding direction of the sliding element in the sliding slot at the moment the sliding element centrally covers the fluid outlet opening. In the rotor position in which the fluid outlet opening is temporarily and briefly completely closed by the sliding element, the longitudinal axis of the elongated fluid outlet opening and the longitudinal axis of the sliding element have a common alignment and/or they overlap each other.

During operation, air is aspirated into the pump compartment via the fluid inlet opening and is then expelled from the pump compartment via the at least one fluid outlet opening. Since the at least one fluid outlet opening is designed as a longitudinal hole, the through-flow cross-section of the fluid outlet opening is large enough that the air can flow out of the pump compartment almost without resistance even at high rotational speed so that the sliding element is not subject to any additional mechanical load. A fluidic short circuit is also prevented since the at least one sliding element briefly completely covers and fluidically closes the at least one fluid outlet opening. The abrasion of the sliding elements is thereby reduced, wherein a good pneumatic efficiency of the vane-type gas pump is achieved.

The tangential width of the at least one sliding element can, for example, be slightly larger, for example, at least a few tenths of a millimeter larger, than the tangential width of the at least one fluid outlet opening, wherein the fluid outlet opening is covered by the at least one sliding element when overlapping. A short circuit between the two adjacent pump compartments is thereby reliably prevented and the abrasion of the at least one sliding element is reduced to a minimum.

In an embodiment, the at least one elongated fluid outlet opening can, for example, comprise in its middle part a constant tangential width over the length. The two end portions of the elongated fluid outlet opening can be designed to be rounded or chamfered. Alternatively, the fluid outlet opening can, for example, be designed so that the tangential width of the fluid outlet opening is downsized in a radial direction relative to the motor rotor.

In a rotational direction, a first fluid outlet opening and a second fluid outlet opening can, for example, be dedicated to the pump chamber, wherein at least the first fluid outlet opening is designed as a longitudinal hole. A greater amount of gas can thus be expelled from the pump compartment without resistance.

The pump housing can, for example, comprise a valve cover, a stroke ring, and a bottom cover. The stroke ring forms the circumferential surface of the pump chamber and sealingly abuts with its first front side on the valve cap and with its other front side on the bottom cover. The valve cover closes the pump chamber on one side. The valve cover can, for example, comprise the at least one fluid outlet opening, and the bottom element can, for example, comprise the fluid inlet opening, wherein a check valve can, for example, be arranged on the valve cover which closes the at least one fluid outlet opening and which releases the fluid outlet opening when an opening pressure prevails in the pump compartment.

The length L of the at least one elongated fluid outlet opening can, for example, correspond with the working chamber width W in a longitudinal direction of the sliding element, wherein the working chamber width W extends from the outer circumferential surface of the pump rotor to the inner circumference of the pump chamber defined by the stroke ring.

The present invention is described in greater detail below under reference to the drawings.

Figure 2:
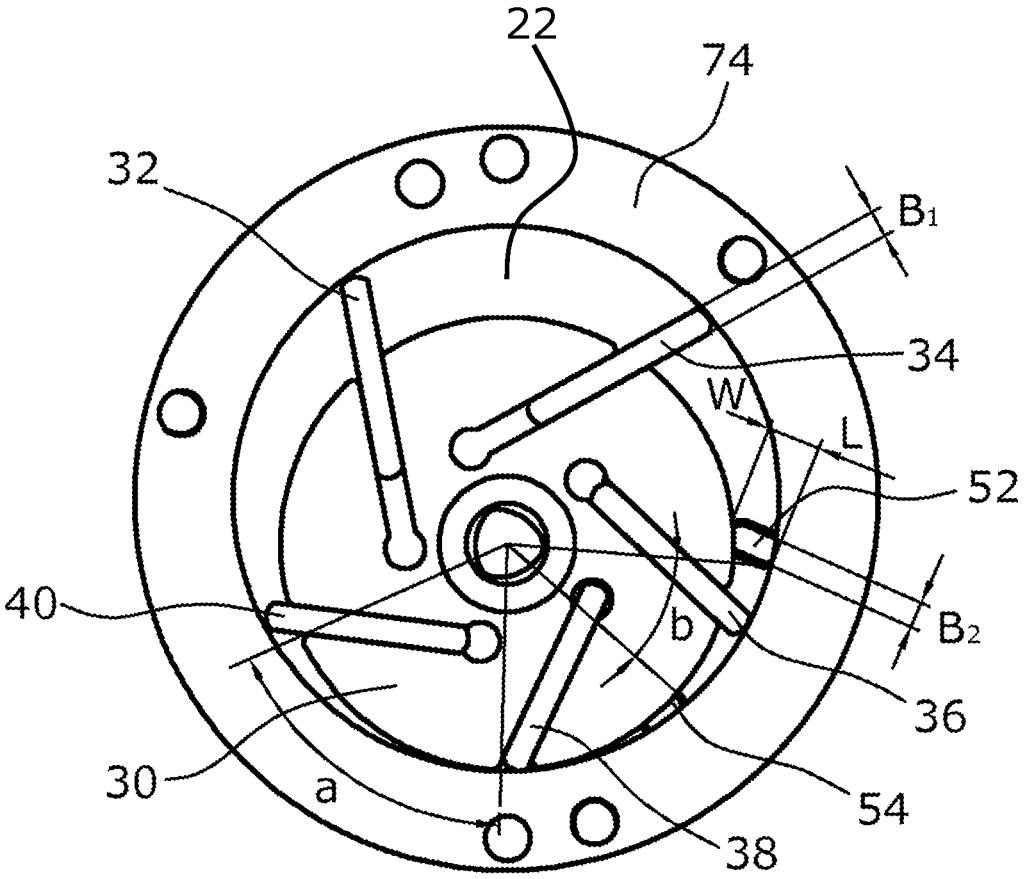
FIG. 2 shows a top view of the pump rotor of the vane-type gas pump of FIG. 1.

FIGS. 1 and 2 show a vane-type gas pump 10 designed as a so-called vacuum pump, which is, for example, designated to be used in vehicles and which can create an absolute pressure of 100 mbar or less. The dry-running vane-type gas pump 10 comprises a metal pump housing 20 surrounding a pump chamber 22. The pump housing 20 substantially comprises a stroke ring 74, a bottom plate 76, and a valve cover 72.

In the pump chamber 22, a pump rotor 30 is rotatably arranged eccentrically to the center of gravity of the pump chamber 22. The pump rotor 30 comprises five sliding slots 321, 341, 361, 381, 401 in which one sliding element 32, 34, 36, 38, 40 is respectively slidably mounted. The five sliding elements 32, 34, 36, 38, 40 divide the pump chamber 22 into five rotating pump compartments which each have the same pump compartment angle a of approximately 70°. The pump rotor 30 is driven by an electric motor 90 in the shown embodiment.

The shown vane-type gas pump 10 is a dry-running vane-type gas pump 10, wherein no lubricant, for example oil, is passed into the pump chamber 22. The vane-type gas pump 10 does not therefore comprise a lubricant connection. To reduce the friction and abrasion of abutting components of the vane-type gas pump 10 and of components of the vane-type gas pump 10 moving relative to each other, the sliding elements 32, 34, 36, 38, 40 comprise a graphite content. The components can alternatively comprise another friction-reducing composition.

The pump chamber 22 can be divided into several sectors, namely, an inlet sector 42 having a fluid inlet opening 60, an outlet sector 44 having a first fluid outlet opening 52 and a second fluid outlet opening 54, and a sealing sector 46 which is arranged between the outlet sector 44 and the inlet sector 42, when viewed in a rotational direction, which prevents a gas flow from the fluid outlet openings 52, 54 to the fluid inlet opening 60 via the sealing gap between the pump rotor 30 and the stroke ring 74.

The fluid inlet opening 60 is provided in the bottom plate 76. The two fluid outlet openings 52, 54 are provided in the valve cover 72 opposite thereto. The first fluid outlet opening 52 is arranged before the second fluid outlet opening 54, when viewed in the rotational direction of the pump rotor 30. A check valve 70 is fluidically dedicated to the first fluid outlet opening 52, wherein the check valve 70 is provided as a reed valve and comprises a valve reed 80 and a path delimiter 82 which are both arranged in a fixed way or screwed onto the valve cover 72.

The first fluid outlet opening 52 is designed as a longitudinal hole. The tangential width B1 of the sliding elements 32, 34, 36, 38, 40 at least corresponds to the tangential width B2 of the first fluid outlet opening 52, wherein the elongated first fluid outlet opening 52 is aligned so that, in predefined rotor positions, the first fluid outlet opening 52 is completely covered by one of the sliding elements 32, 34, 36, 38, 40 and is thus completely closed for a short period of time. In the rotor positions in which the first fluid outlet opening 52 is briefly closed by a sliding element 32, 34, 36, 38, 40, the longitudinal axis of the closed first fluid outlet opening 52 and the longitudinal axis of the corresponding sliding element 32, 34, 36, 38, 40 have a common identical alignment.

When the vane-type gas pump 10 is operated, the air is aspirated due to the rotation of the pump rotor 30 through the fluid inlet opening 60 into the corresponding pump compartment and expelled through the two fluid outlet openings 52, 54 from the still rotating pump compartment. As long as a predefined overpressure prevails in the pump compartment, the first fluid outlet opening 52 is released and the air is expelled through the first fluid outlet opening 52. The air is also expelled through the second fluid outlet opening 54 as soon as the corresponding pump compartment reaches it.

Since the first fluid outlet opening 52 is designed as a longitudinal hole, the through-flow area of the first fluid outlet opening 52 is large enough to allow the air to flow out of the pump compartment almost without resistance so that the sliding elements 32, 34, 36, 38, 40 are not subject to any additional mechanical load in a tangential direction. A short circuit between the two adjacent pump compartments is also prevented since the sliding elements 32, 34, 36, 38, 40 temporarily completely cover and close the fluid outlet openings 52, 54. Backflow losses are therefore equal to zero. The abrasion of the sliding elements 32, 34, 36, 38, 40 is thereby reduced without reducing the pneumatic efficiency of the vane-type gas pump 10.

It should be clear that other constructive embodiments of the dry-running gas pump are possible compared to the described embodiments. The number of sliding elements can, for example, be varied or the fluid inlet opening and/or the fluid outlet opening can be provided at other housing components. Reference should also be had to the appended claims.

What is claimed is:

1. A vane gas pump for a compressible fluid, the vane gas pump comprising:

a pump housing which is configured to form a pump chamber in which a pump rotor comprising at least one slidable sliding element is rotatably mounted, at least one fluid inlet opening and at least one elongated fluid outlet opening being dedicated to the pump chamber, wherein, the at least one slidable sliding element comprises a tangential width, the at least one elongated fluid outlet opening comprises a tangential width, the tangential width of the at least one slidable sliding element at least corresponds to the tangential width of the at least one elongated fluid outlet opening so that the at least one slidable sliding element temporarily completely covers the at least one elongated fluid outlet opening the pump chamber, when viewed from a rotational direction, comprises the at least one elongated fluid outlet opening as a first fluid outlet opening and as a second fluid outlet opening, each of the first fluid outlet opening and the second fluid outlet opening are dedicated to the pump chamber, a check valve is dedicated to the first fluid outlet opening, and no valve is dedicated to the second fluid outlet opening.

2. The vane gas pump as recited in claim 1, wherein the tangential width of the at least one slidable sliding element is larger than the tangential width of the at least one elongated fluid outlet opening.

3. The vane gas pump as recited in claim 1, wherein, the at least one elongated fluid outlet opening further comprises a length, and the tangential width of the at least one elongated fluid outlet opening is constant over the length.

4. The vane gas pump as recited in claim 3, wherein, the pump chamber is configured to have a width, and the length of the at least one elongated fluid outlet opening corresponds with the width in a longitudinal direction of the at least one slidable sliding element.

5. The vane gas pump as recited in claim 1, wherein the first fluid outlet opening is provided as a longitudinal hole which is oriented in a longitudinal direction of the at least one slidable sliding element.

6. The vane gas pump as recited in claim 1, wherein the pump housing comprises a thrust washer, a stroke ring, and a bottom element which define the pump chamber.

7. The vane gas pump as recited in claim 6, wherein, the at least one fluid inlet opening is arranged at the bottom element, and the at least one elongated fluid outlet opening is arranged at the thrust washer.

* * * * *